US010704778B2

(12) United States Patent
Desai et al.

(10) Patent No.: US 10,704,778 B2
(45) Date of Patent: Jul. 7, 2020

(54) LED FIXTURE

(71) Applicant: Appleton Grp LLC, Rosemont, IL (US)

(72) Inventors: Suraj N. Desai, Moshi (IN); Harsha N. Devappa, Pune (IN); Dawn M. Grandsart, Chicago, IL (US); Timothy E. Graff, Arlington Heights, IL (US); James G. Brand, Schaumburg, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 16/034,634

(22) Filed: Jul. 13, 2018

(65) Prior Publication Data

US 2019/0301718 A1 Oct. 3, 2019

(30) Foreign Application Priority Data

Mar. 29, 2018 (IN) ..... 201821011905

(51) Int. Cl.

| | |
|---|---|
| ***F21V 23/00*** | (2015.01) |
| ***F21V 29/503*** | (2015.01) |
| ***F21V 17/12*** | (2006.01) |
| ***F21V 31/00*** | (2006.01) |
| ***F21V 17/06*** | (2006.01) |
| ***F21V 29/70*** | (2015.01) |
| *F21Y 115/10* | (2016.01) |

(52) U.S. Cl.

CPC ..... *F21V 29/503* (2015.01); *F21V 17/06* (2013.01); *F21V 17/12* (2013.01); *F21V 23/006* (2013.01); *F21V 23/008* (2013.01); *F21V 23/009* (2013.01); *F21V 29/70* (2015.01); *F21V 31/005* (2013.01); *F21Y 2115/10* (2016.08)

(58) Field of Classification Search

CPC ..... F21V 17/12; F21V 23/003–004; F21V 23/006–008

See application file for complete search history.

(56) References Cited

U.S. PATENT DOCUMENTS

| | | | | |
|---|---|---|---|---|
| 2011/0242828 | A1* | 10/2011 | Blincoe | F21V 31/005 362/373 |
| 2013/0223085 | A1* | 8/2013 | Peng | F21V 1/00 362/477 |
| 2017/0067622 | A1* | 3/2017 | Chao | F21V 19/006 |
| 2019/0203924 | A1 | 7/2019 | Devappa et al. | |

OTHER PUBLICATIONS

Prior Art Rig-a-Lite Catalog "LED Area Lighting for Harsh Environments" pp. 1-14.

(Continued)

*Primary Examiner* — Sean P Gramling

(74) *Attorney, Agent, or Firm* — McDonnell Boehnen Hulbert & Berghoff LLP

(57) ABSTRACT

An LED fixture is provided including a housing having a hollow configuration, a mounting plate secured to an upper end of the housing, a globe ring, separate from the housing, secured to a lower exterior end of the housing, a base on the housing extending within the globe ring, and an LED array positioned on the base of the housing.

4 Claims, 6 Drawing Sheets

(56) References Cited

OTHER PUBLICATIONS

Prior Art Rig-a-Lite Partnership Ltd. "IGIV.E128569—Luminaire Fittings for use in Hazardous Location" htps//iq.ulprospetor.com/en/profile?e=57846printed May 20, 2019, pp. 1-3.
Prior Art Mercmaster Low Profile 1.0 figures, pp. 1-2.
Heyco Cordgrip Brochure: Heyco V-O Nylon and Metal Liquid Tight Cordgrips, 2013, 20 pages.
Appleton Brochure: Installation Instructions for Industrial Mercmaster LED Low Profile Luminaire, 2016, 10 pages.

* cited by examiner

LED FIXTURE

RELATED APPLICATION

This application claims priority to Indian Patent Application No. 201821011905 entitled "Improved LED Fixture" filed on Mar. 29, 2018, the contents of which are incorporated by reference in their entirety.

FIELD

The present disclosure relates to the field of light fixtures. Particularly, the present disclosure relates to the field of LED fixtures.

BACKGROUND

Light sources, such as light emitting diodes (hereinafter "LEDs"), have relatively high operating temperatures. In order to increase the overall lighting brightness, a plurality of LEDs is often incorporated into a single lamp, which generates a high amount of heat. Conventionally, the heat generated by the LED lights is dissipated by providing an enclosure that includes a housing with a plurality of fins extending therefrom. The LEDs are fitted on a heat sink puck within the housing. On the opposite side of the heat sink puck, LED drivers are mounted. Any increase in temperature of the LEDs increases the temperature of the drivers. Further, as the LEDs and the LED drivers are mounted on the same heat sink puck, the heat dissipation capacity of the enclosure is reduced. Further, absence of any thermal barrier between the LED drivers and the LEDs reduces the efficiency of the LEDs and performance of the LED drivers. Moreover, the heat dissipation efficiency of the enclosure substantially decreases as the heat dissipation is not uniform.

In addition, prior art LED fixtures have included a finless design using a single die-cast aluminum housing with integral globe collar, machined heat sink puck, stamped mounting plate, and globe (protective transparent cover which allows light from an LED to pass through). In this example, an LED array, LED driver, connectors, and terminal block are positioned within the enclosure. The LED array is mounted on the heat sink puck. The LED driver is mounted on the opposite side of the heat sink puck. In this example, a gap between the sides of the heat sink puck and the housing adds resistance to the flow of heat generated by the LEDs resulting in ineffective thermal utilization of the aluminum housing. Furthermore, having the LED driver mounted on the back side of the heat sink puck from the LED array results in an increase in the $T_c$ point which may cause the LED driver to switch off and reduce performance.

Therefore, it would be desirable to provide an LED fixture with improved thermal performance.

SUMMARY

An improved LED fixture is provided advantageously include an aluminum housing and an aluminum globe ring, separate from the aluminum housing, secured to a lower exterior end of the aluminum housing. In addition, the aluminum housing includes an integral base that downwardly extends within the globe ring. An LED array is mounted to a bottom surface of the base, and heat generated by the LED array is dissipated through the base and sides of the aluminum housing. In this manner, the need for a heat sink puck is eliminated.

Furthermore, in one embodiment the LED fixture is provided with a mounting plate that serves as an LED driver heat sink. The mounting plate advantageously includes a hollow compartment and lower platform (which may be a top surface of the aluminum housing) within which LED drivers may be positioned. In this manner, the mounting plate serves as a heat sink providing thermal separation between the LED drivers and the LED array. In addition, the LED drivers are positioned in a spaced apart configuration from the LED array. Due to the thermal separation provided by the hollow compartment and lower platform and the spaced apart configuration of the LED drivers and LED array, heat generated by the LED array does not adversely affect the LED drivers.

In one aspect, an LED fixture is provided including a housing having a hollow configuration, a mounting plate secured to an upper end of the housing, a globe ring, separate from the housing, secured to a lower exterior end of the housing, a base on the housing extending within the globe ring, and an LED array positioned on the base of the housing.

In another aspect, means for dissipating heat from an LED array is provided and means for thermally separating LED drivers from an LED array is provided.

DETAILED DESCRIPTION

Figure 1A:
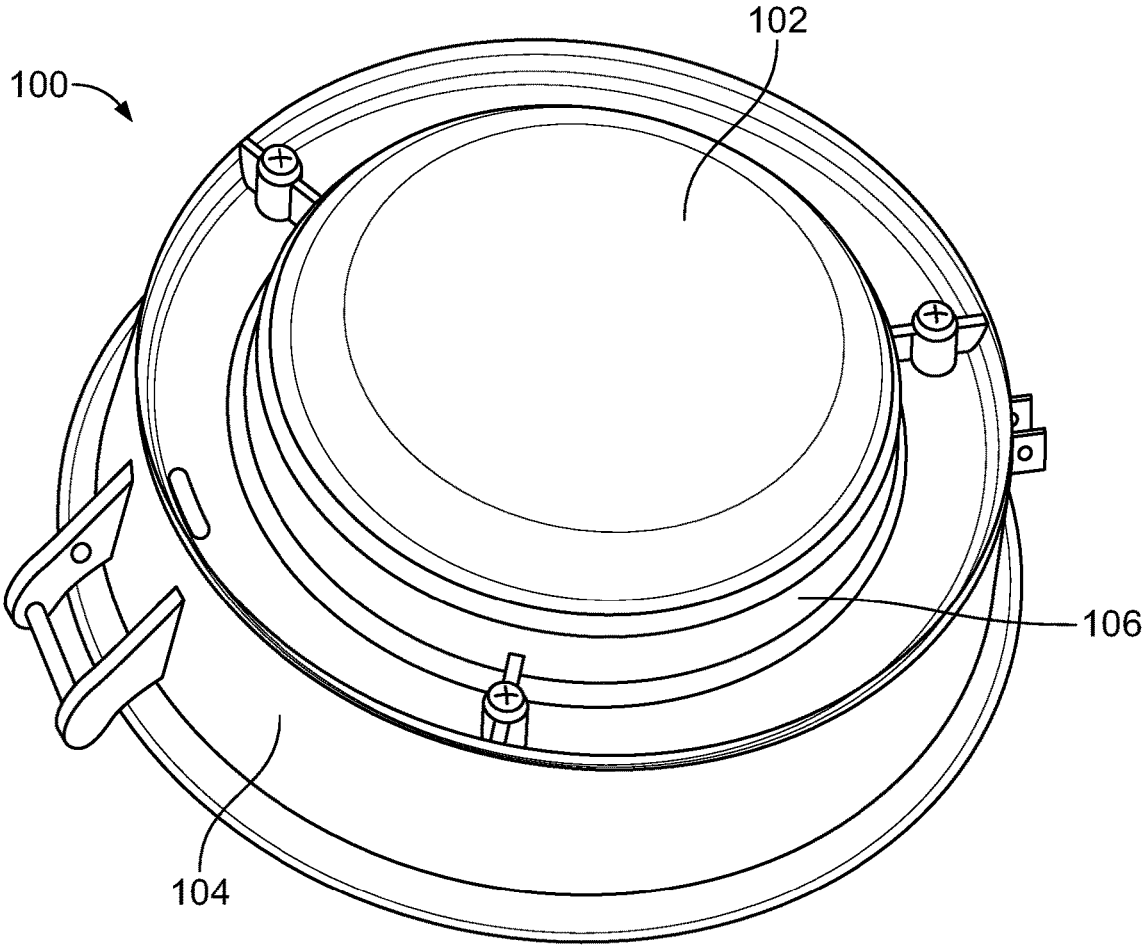
(PRIOR ART) FIG. 1A
FIG. 1A is a perspective view of prior art LED fixture 100.
Figure 1B:
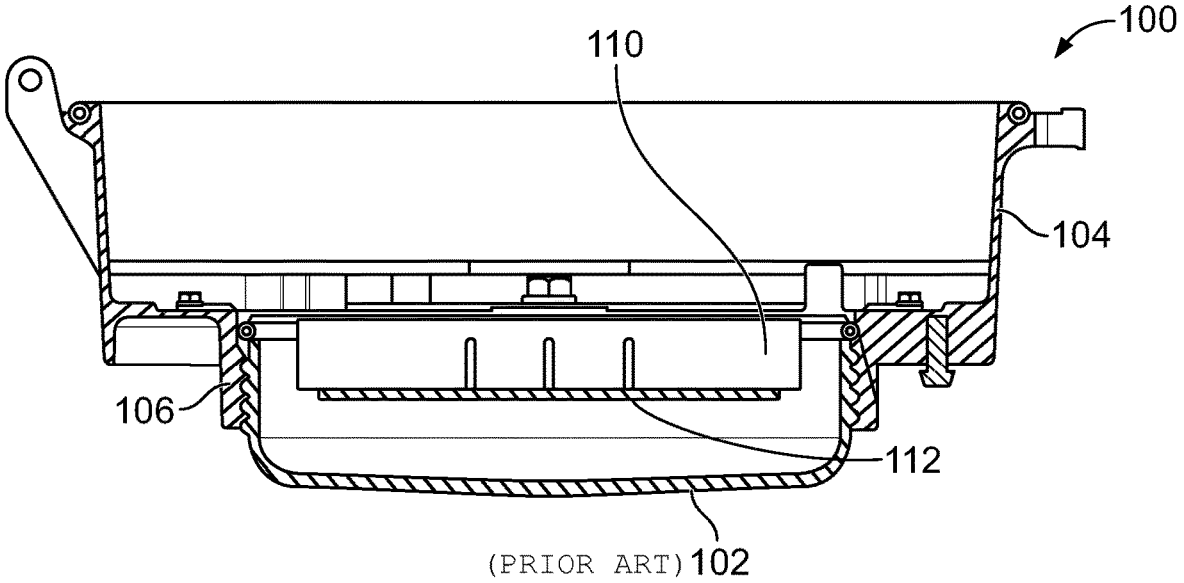
(PRIOR ART) FIG. 1B
FIG. 1B is a cross-sectional view of prior art LED fixture 100 shown in FIG. 1A.

FIGS. 1A and 1B illustrate a prior art LED fixture 100. LED fixture 100 includes an aluminum housing 104 having an integral globe ring 106 with a transparent globe 102 in threaded engagement with the integral globe ring 106. Because the globe ring 106 is integrally formed with aluminum housing 104, an aluminum heat sink puck 110 is required to extend downwardly within the globe ring 106 so that an LED array 112 mounted on a bottom surface of the aluminum heat sink puck 110 is in a desired position within the globe ring 106 and globe 102 attached to the globe ring 106. The aluminum heat sink puck 110 is positioned within the interior of the integral globe ring 106 having an LED array 112 positioned on a bottom surface of the aluminum puck 110.

The heat sink puck 110 is fitted within the integral globe ring 106 and an LED array 112 is fitted on a bottom side of the heat sink puck 110. On the opposite side of the heat sink puck 106, a plurality of LED drivers (not shown in figures) are mounted. The LED array 112 is mounted on the heat sink puck 110 using a thermal interface compound. During operation, the LED array 112 generates a large amount of heat which increases the temperature of the LEDs. The heat generated by the LEDs within the aluminum housing 104 is removed via the heat sink puck 110. However, there is a gap formed between the heat sink puck 110 and the aluminum housing 104. This gap adds resistance to the heat flow, thereby reducing the heat removal from the LED array 112. The reduction in heat removal increases the temperature of the LED array 112. As both the LED array 112 and the LED driver are mounted on the same heat sink puck 110, an increase in temperature of the LED array 112 also increases the temperature of the LED drivers. If the LED driver temperature rises above a certain limit, the LED driver stops functioning and the LED array 112 fails.

Typically, a maximum operating temperature of the LEDs is 150° Celsius. If LEDs are operated above the operating temperature, it can cause permanent damage to the LEDs.

Therefore, there is a need for an LED fixture that alleviates the above-mentioned drawbacks of conventional LED fixtures and effectively dissipates the heat generated by LEDs and LED drivers.

FIGS. 2A-D illustrate LED fixture 200. LED fixture 200 includes a finless aluminum housing 204 which acts as a heat sink, and an aluminum globe ring 206 which is separate from the aluminum housing 204, and the aluminum globe ring 206 is secured to a lower exterior end of aluminum housing 204. Aluminum housing 204 has a hollow configuration. Mounting plate 208 is hingedly secured to an upper end of aluminum housing 204 and serves a mounting hood. Transparent globe 202 is threadingly secured to aluminum globe ring 206.

Figure 2A:
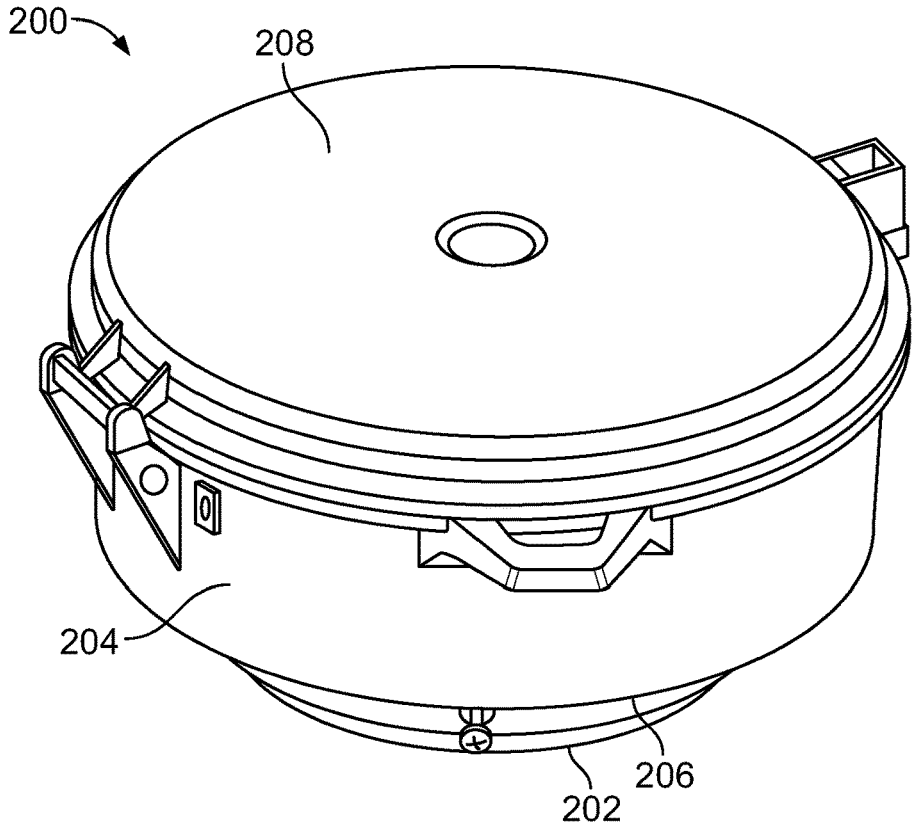
FIG. 2A is a perspective top view of LED fixture 200, according to an example embodiment.
Figure 2B:
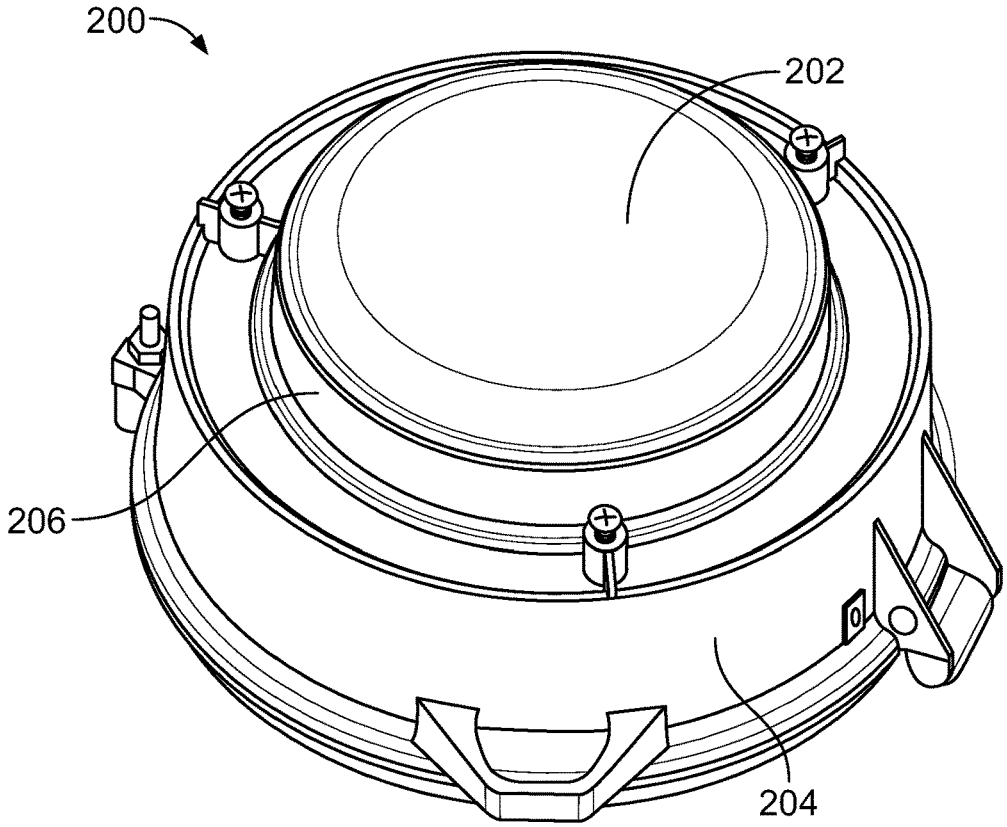
FIG. 2B is a perspective bottom view of LED fixture 200 shown in FIG. 2A.
Figure 2C:
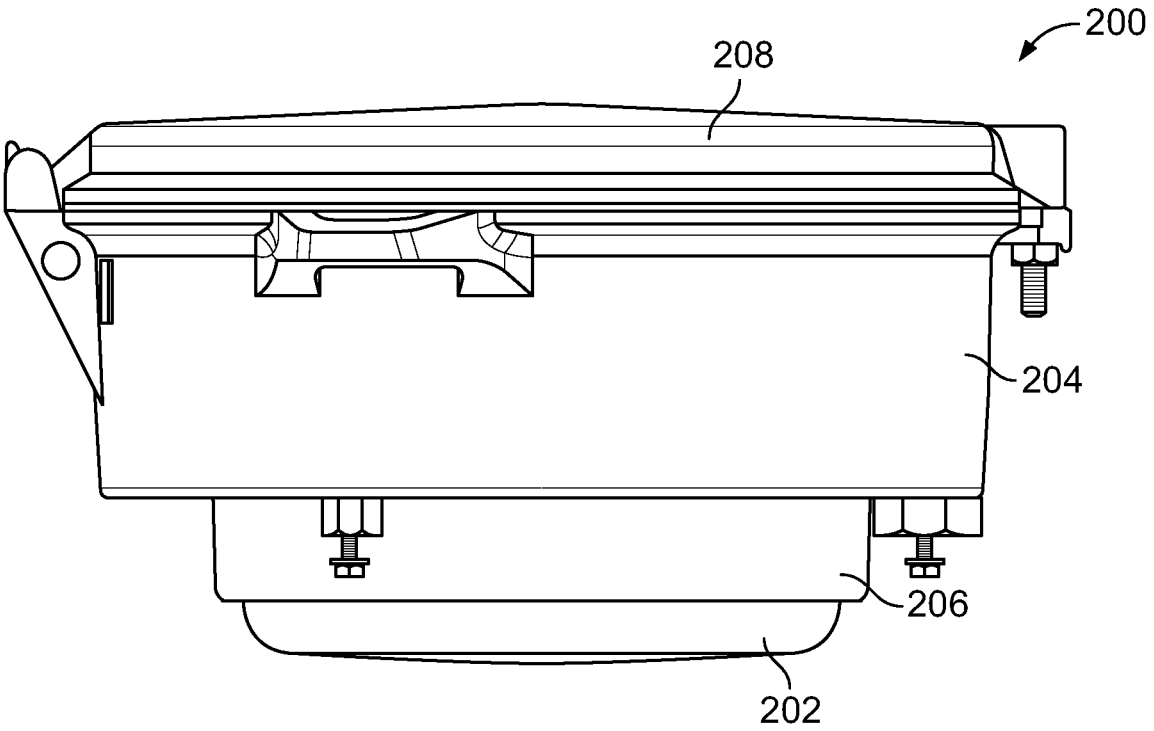
FIG. 2C is a side view of LED fixture 200 shown in FIGS. 2A and 2B.
Figure 2D:
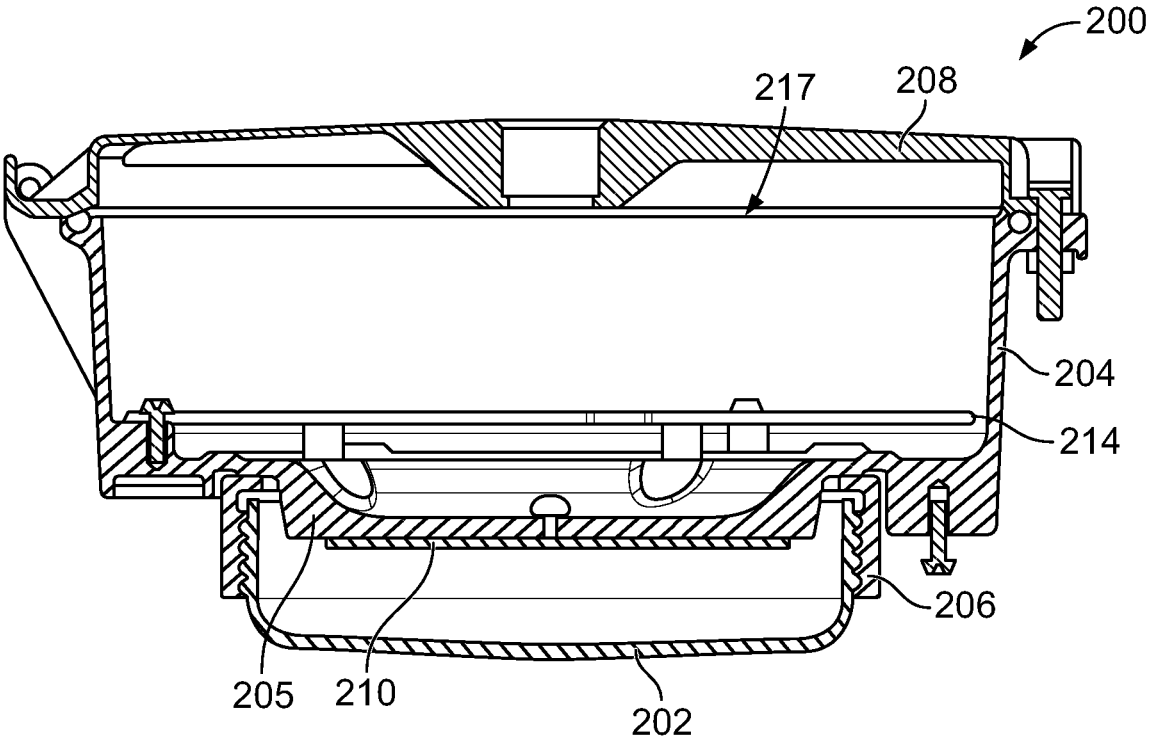
FIG. 2D is a cross-section view of LED fixture 200 shown in FIGS. 2A-C.

FIG. 2C is a cross-sectional view of LED fixture 200. An LED array 210 is positioned on a bottom of base 205 of aluminum housing 204, such that the LED array 210 and base 205 extend within aluminum globe ring 206. Because the globe ring 206 is separate from the aluminum housing 204, the aluminum housing may include base 205 that extends within globe ring 206 upon which the LED array 210 is mounted. As a result, the need for a heat sink puck is eliminated. Consequently, heat generated by the LED array 210 may be dissipated through the base 205 and sides of aluminum housing 204. With this configuration, the drawbacks associated with dissipating heat from the LED array when the LED array is mounted to a heat sink puck and associated air gap is advantageously eliminated. Therefore, LED fixture 200 provides for a thermally optimized heat sink and uniform dissipation of heat from the LED array.

LED fixture 200 includes globe ring 206 extending in an operative downward direction from the housing 204. In an embodiment, the globe ring 206 has a cylindrical cross section. Internal threads are configured on the globe ring 206 adapted for engagement with external threads on the globe 202.

Globe 202 is threadably connected to the globe ring 206 with a gasket positioned therebetween. The globe 202 is configured to prevent damage to the LED array 210. In an embodiment, the globe 202 is made of glass, plastic or any other suitable transparent material. The globe 202 can have any suitable or desired shape.

The globe 202 facilitates quick access to the LED array 210 during maintenance and replacement of the LEDs, as the globe 202 can be easily removed from the globe ring 206.

In other embodiments, rather than attaching a globe to the globe ring, a refractor and guard may be secured to the globe ring.

The LED fixture 200 further includes a mounting plate 208 that extends over the top of aluminum housing 204 and serves as a mounting hood which may be attached to a downwardly extending conduit. One or more LED drivers may be positioned on mounting platform 214 positioned within aluminum housing 204. Thus, mounting platform 214 provides for a thermal separation between the LED drivers and the LED array 210. In this manner, the LED drivers are positioned on mounting platform 214 such that they are advantageously positioned away from the LED array 210. As a result, because of the thermal separation provided by mounting platform 214 and distance from the LED array 210, the LED drivers positioned on mounting platform 214 are not materially affected by heat generated from LED array 210. The LED drivers can be easily removed from the mounting platform 214 for maintenance. In case the LED drivers fail to function, the LED drivers can be replaced.

Mounting plate 208 is connected to an upper end of aluminum housing 204, and a gasket may be positioned therebetween to provide a sealing engagement.

In addition, as discussed in further detail below, a water tight cord grip may be positioned within a threaded aperture in mounting plate 208 to provide for LED fixture 200 to be entirely sealed, such that dirt, debris, water and moisture cannot enter the LED fixture 200 and cause damages to the electrical components positioned therein.

FIGS. 3A-E illustrate LED fixture 300. LED fixture 300 includes an aluminum housing 304 which acts as a heat sink, and an aluminum globe ring 306 which is separate from the aluminum housing 304, and the aluminum globe ring 306 is secured to a lower exterior end of aluminum housing 304. Aluminum housing 304 has a hollow configuration. Mounting plate 308 serves as an LED driver heat sink and is secured to an upper end of aluminum housing 304. Transparent globe 302 is threadingly secured to aluminum globe ring 306.

Figure 3A:
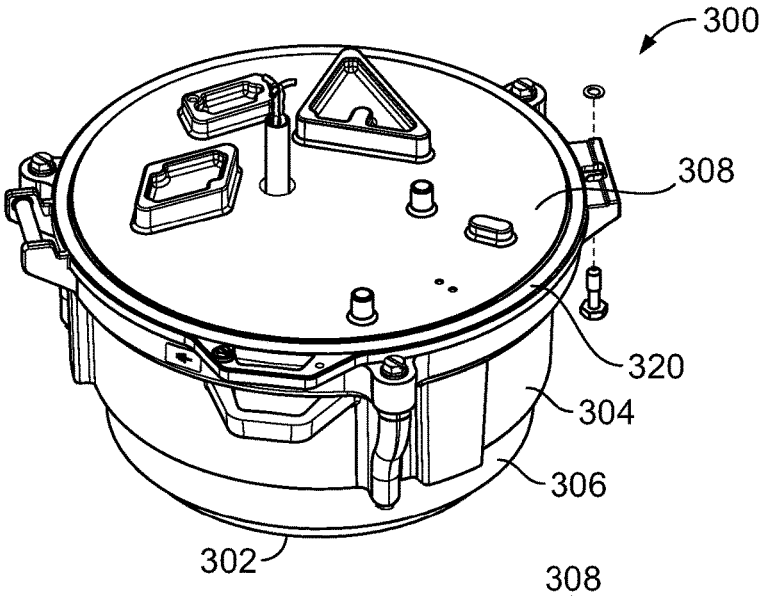
FIG. 3A is a perspective top view of LED fixture 300, according to an example embodiment.
Figure 3B:
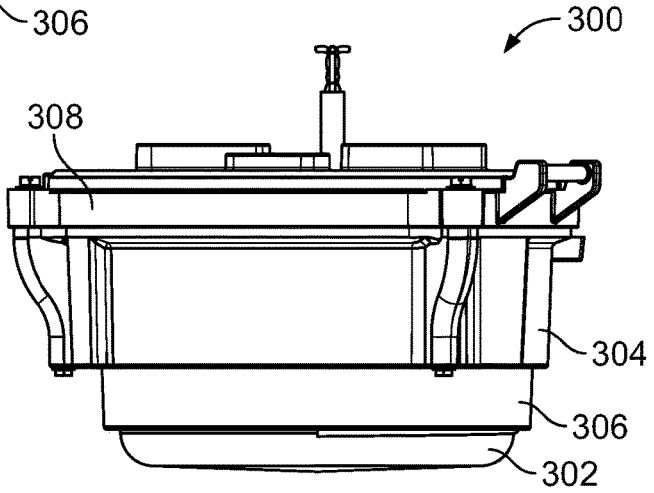
FIG. 3B is a side view of LED fixture 300 shown in FIG. 3A.
Figure 3C:
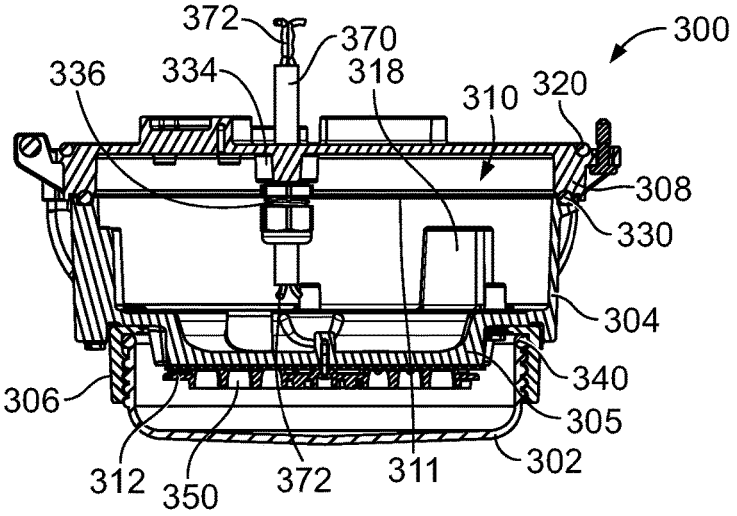
FIG. 3C is a cross-sectional view of LED fixture 300 shown in FIGS. 3A and 3B.

FIG. 3C is a cross-sectional view of LED fixture 300. An LED array 312 is positioned on a bottom of base 305 of aluminum housing 304, such that the LED array 312 and base 305 extend within aluminum globe ring 306. Because the globe ring 306 is separate from the aluminum housing 304, the aluminum housing may include base 305 that extends within globe ring 306 upon which the LED array 312 is mounted. As a result, the need for a heat sink puck is eliminated. Consequently, heat generated by the LED array 312 may be dissipated through the base 305 and sides of aluminum housing 304. With this configuration, the drawbacks associated with dissipating heat from the LED array when the LED array is mounted to a heat sink puck and associated air gap is advantageously eliminated. Therefore, LED fixture 300 provides for a thermally optimized heat sink and uniform dissipation of heat from the LED array.

LED fixture 300 includes globe ring 306 extending in an operative downward direction from the housing 304. In an embodiment, the globe ring 306 has a cylindrical cross section. Internal threads are configured on the globe ring 306 adapted for engagement with external threads on the globe 302.

Globe 302 is threadably connected to the globe ring 306 with a gasket 340 positioned therebetween. The globe 302 is configured to prevent damage to the LED array 312. In an embodiment, the globe 302 is made of glass, plastic or any other suitable transparent material. The globe 302 can have any suitable or desired shape.

The globe 302 facilitates quick access to the LED array 312 during maintenance and replacement of the LEDs, as the globe 302 can be easily removed from the globe ring 306.

In other embodiments, rather than attaching a globe to the globe ring, a refractor and guard may be secured to the globe ring.

The LED fixture 300 further includes a mounting plate 308 that extends over the top of aluminum housing 304. One or more LED drivers may be positioned within hollow area 310 above lower surface 311. The lower surface 311 could also be positioned as a top surface of aluminum housing 304. Thus, mounting plate 308 provides for a thermal separation between the LED drivers and the LED array 312. In this manner, the LED drivers are positioned on mounting plate 308 such that they are advantageously positioned far from the LED array 312. As a result, because of the thermal separation provided by mounting plate 308 and distance from the LED array 312, the LED drivers positioned within hollow area 310 are not adversely affected by heat generated from LED array 312. The LED drivers can be easily removed from the mounting plate 308 for maintenance. In case the LED drivers fail to function, the LED drivers can be replaced.

Mounting plate 308 is connected to an upper end of aluminum housing 204, and a gasket 330 may be positioned therebetween to provide a sealing engagement.

In addition, a water tight cord grip 336 may be positioned within a threaded aperture in downwardly extending portion 334 in mounting plate 308 to provide for LED fixture 300 to be entirely sealed, such that dirt, debris, water and moisture cannot enter the LED fixture 300 and cause damages to the electrical components positioned therein. Further details of water tight cord grip 336 are set forth in pending U.S. patent application Ser. No. 15/818,391 entitled "Lighting Device with Mounting Hood Having Internal Threaded Sealing Device" filed on Nov. 20, 2017 the description of the water tight cord grip incorporated by reference herein in its entirety.

FIG. 3C further shows conduit 370 threaded into mounting plate 308 with electrical wires 372 extending therethrough into the hollow interior of aluminum housing 304 where they may be contacted to electrical components, such as terminal block 318 within the aluminum housing 308.

A gasket 320 is shown on the upper periphery of mounting plate 308 which may be used for sealing engagement with another fixture.

Figure 3D:
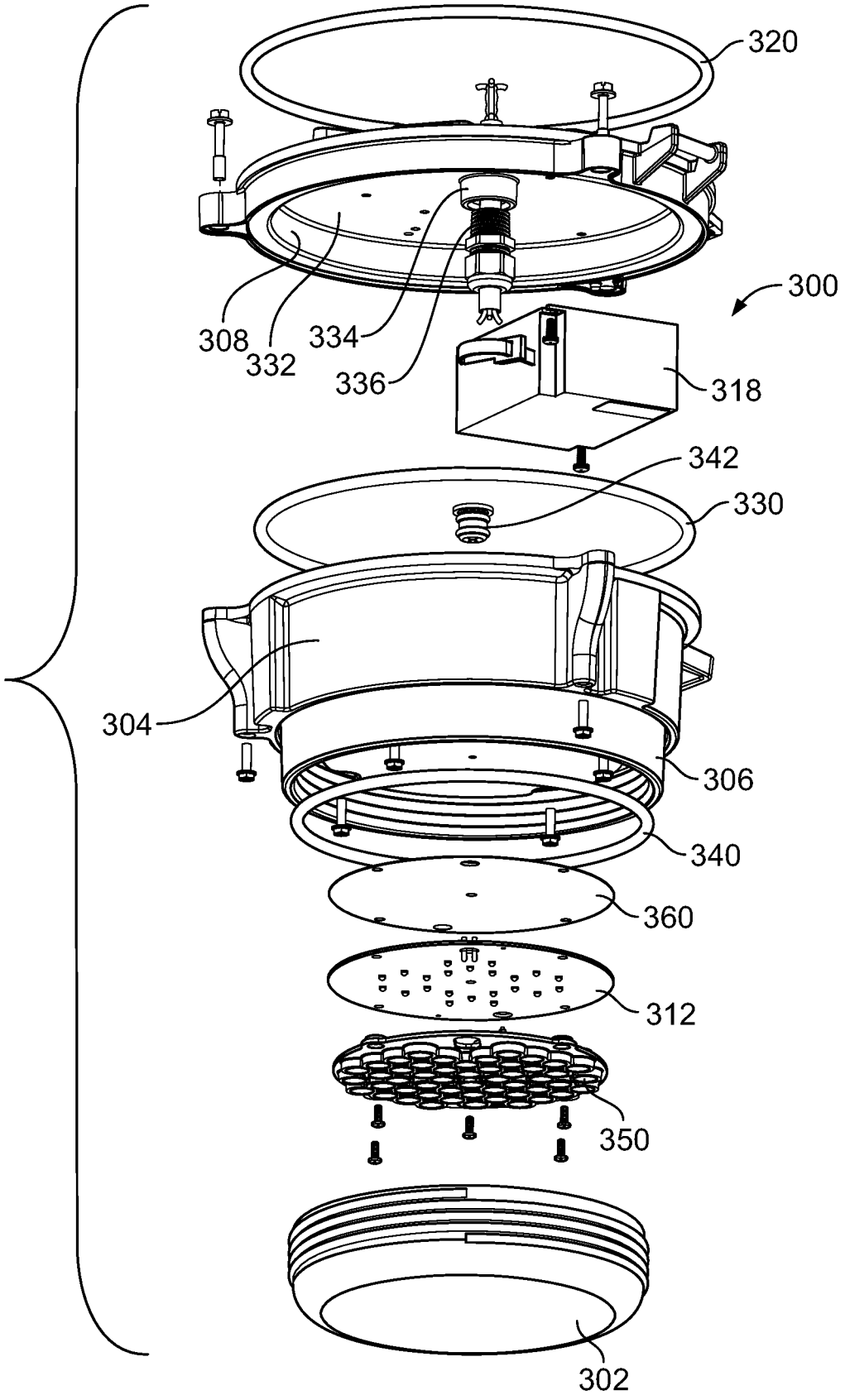
FIG. 3D is an exploded view of LED fixture 300 shown in FIGS. 3A-C.
Figure 3E:
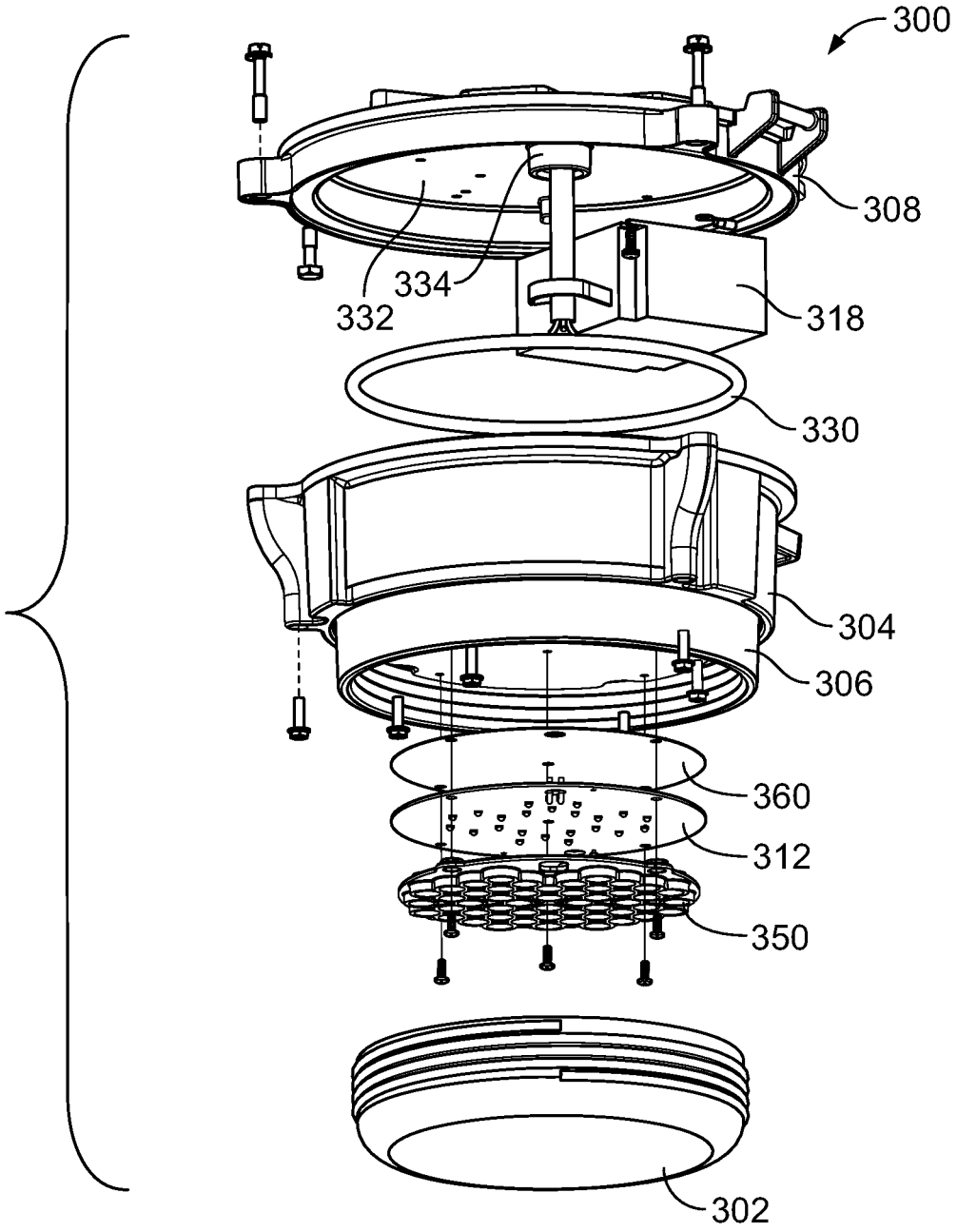
FIG. 3E is another exploded view of LED fixture 300 shown in FIGS. 3A-C.

FIGS. 3D and 3E are exploded views of the components of LED fixture 300. As shown in these exploded views, globe 302 is shown positioned beneath LED array 312, LED reflector plate 350 and thermal interface material 360, and beneath globe ring 306 and aluminum housing 304. In FIG. 3D, gasket 340 is shown which is used for sealing engagement of globe 302 and globe ring 306. Gasket 330 is shown above aluminum housing 304 that provides sealing engagement between aluminum housing 304 and mounting plate 308. Terminal block 318 is shown that is positioned within aluminum housing 304. Mounting plate 308 is shown with upper surface 332 and downwardly extending portion 334 into which water tight cord grip 336 is threaded.

A gasket 320 is shown on the upper periphery of mounting plate 308 which may be used for sealing engagement with another fixture, such as a mounting hood. As a result, mounting plate 308 advantageously includes a dual gasket configuration, wherein lower gasket 330 serves to sealingly engage a lower portion of mounting plate 308 with an upper surface of aluminum housing 304, and upper gasket 320 serves to sealingly engage an upper portion of mounting plate 308 with another fixture, such as a mounting hood.

Also shown in FIG. 3D is a rubber seal 342 through which wiring from LED drivers may pass through and rubber seal 342 serves to prevent water or moisture from passing therethrough.

As described herein, the aluminum housing 304 and aluminum globe ring 306 are described as being made of aluminum which may be cast pieces. Alternatively, housing 304 and glove 306 could be made of any other conductive material as well, such as metal, steel, cast iron, beryllium, etc., and may be formed from methods other than casting.

We claim:

1. An LED fixture comprising:

a housing having a hollow configuration;

a mounting plate secured to an upper end of the housing;

a globe ring, separate from the housing, secured to a lower exterior end of the housing;

a base on the housing extending within the globe ring; and an LED array positioned on the base of the housing;

wherein a transparent globe is mounted to the globe ring;

wherein a first gasket is positioned between the transparent globe and the globe ring; and a second gasket is positioned between the mounting plate and the upper end of the housing;

wherein the mounting plate includes an upper aperture positioned on an upper portion of the mounting plate;

wherein the mounting plate includes a lower aperture positioned in an interior of the mounting plate which is in communication with the upper aperture of the mounting plate;

wherein the lower aperture includes threads;

a water tight cord grip having an upper portion with threads in threaded engagement with the threads of the lower aperture of the mounting plate;

wherein the water tight cord grip has a base positioned beneath the upper portion of the water tight cord grip; and wherein electrical wiring may pass through one or more openings in the base and through the upper portion of the water tight cord grip, and also pass through the lower aperture positioned in the interior of the mounting plate and pass through the upper aperture positioned on the upper surface of the mounting plate.

2. The LED fixture of claim 1, wherein there are no fins on an exterior of the housing.

3. The LED fixture of claim 1, wherein the base of the housing is integrally formed with sides of the housing and heat generated by the LED array is dissipated through the base and a sides of the housing to the atmosphere.

4. The LED fixture of claim 1, wherein the housing and the globe ring are comprised of aluminum.

* * * * *